US009239164B2

(12) United States Patent
Iida et al.

(10) Patent No.: US 9,239,164 B2
(45) Date of Patent: Jan. 19, 2016

(54) SLAG MONITORING DEVICE FOR COAL GASIFIER AND COAL GASIFIER

(75) Inventors: Masami Iida, Tokyo (JP); Yoshinori Koyama, Tokyo (JP); Katsuhiko Yokohama, Tokyo (JP); Naoki Suganuma, Tokyo (JP); Mutsuaki Taguchi, Tokyo (JP)

(73) Assignees: MITSUBISHI HITACHI POWER SYSTEMS, LTD., Yokohama (JP); HOKKAIDO ELECTRIC POWER COMPANY, INCORPORATED, Hokkaido (JP); TOHOKU ELECTRIC POWER CO., INC., Miyagi (JP); THE TOKYO ELECTRIC POWER COMPANY, INCORPORATED, Tokyo (JP); CHUBU ELECTRIC POWER CO., INC., Aichi (JP); HOKURIKU ELECTRIC POWER COMPANY, Toyama (JP); THE KANSAI ELECTRIC POWER CO., INC., Osaka (JP); THE CHUGOKU ELECTRIC POWER CO., INC., Hiroshima (JP); SHIKOKU ELECTRIC POWER CO., INC., Kagawa (JP); KYUSHU ELECTRIC POWER CO., INC., Fukuoka (JP); ELECTRIC POWER DEVELOPMENT CO., LTD., Tokyo (JP); CENTRAL RESEARCH INSTITUTE OF ELECTRIC POWER INDUSTRY, Tokyo (JP); JOBAN JOINT POWER CO., LTD., Tokyo (JP)

( * ) Notice: Subject to any disclaimer, the term of this patent is extended or adjusted under 35 U.S.C. 154(b) by 983 days.

(21) Appl. No.: 13/395,558

(22) PCT Filed: Sep. 17, 2010

(86) PCT No.: PCT/JP2010/066249
§ 371 (c)(1),
(2), (4) Date: Mar. 12, 2012

(87) PCT Pub. No.: WO2011/034184
PCT Pub. Date: Mar. 24, 2011

(65) Prior Publication Data

US 2012/0167543 A1 Jul. 5, 2012

(30) Foreign Application Priority Data

Sep. 17, 2009 (JP) ..... 2009 216050

(51) Int. Cl.

| | |
|---|---|
| ***C10J 3/46*** | (2006.01) |
| ***F23J 1/00*** | (2006.01) |
| ***F23J 1/08*** | (2006.01) |
| ***F23N 5/08*** | (2006.01) |
| ***F27D 3/14*** | (2006.01) |
| ***F27D 21/02*** | (2006.01) |
| ***C10J 3/48*** | (2006.01) |
| ***C10J 3/72*** | (2006.01) |

(52) U.S. Cl.

CPC .. *F23J 1/00* (2013.01); *C10J 3/485* (2013.01); *C10J 3/72* (2013.01); *C10J 3/723* (2013.01); *F23J 1/08* (2013.01); *F23N 5/082* (2013.01); *F27D 3/14* (2013.01); *F27D 21/02* (2013.01); *C10J 2300/093* (2013.01); *F23J 2900/01009* (2013.01)

(56) References Cited

(58) Field of Classification Search
CPC combination set(s) only.
See application file for complete search history.

(56) References Cited

U.S. PATENT DOCUMENTS

2010/0207785 A1 8/2010 Suganuma et al.

FOREIGN PATENT DOCUMENTS

| | | |
|---|---|---|
| CA | 2 706 887 | 9/2009 |
| JP | 2566357 | 12/1996 |
| JP | 9-264524 | 10/1997 |
| JP | 2000-304232 | 11/2000 |
| JP | 2001-19975 | 1/2001 |
| JP | 2001-33024 | 2/2001 |
| JP | 2002-147731 | 5/2002 |
| JP | 2002-295824 | 10/2002 |
| JP | 2003-294219 | 10/2003 |
| JP | 2004-91571 | 3/2004 |
| JP | 2006-118744 | 5/2006 |
| WO | 2009/107253 | 9/2009 |

OTHER PUBLICATIONS

Notification of the Decision to Grant a Patent Right for Patent for Invention issued May 14, 2014 in corresponding Chinese Patent Application No. 201080041027.5 with English translation.

Notification of Fulfilling of Registration Formality issued May 14, 2014 in corresponding Chinese Patent Application No. 201080041027.5 with English translation.

Extended European Search Report issued Oct. 28, 2014 in corresponding European Patent Application No. 10817297.4.

International Search Report issued Nov. 16, 2010 in International (PCT) Application No. PCT/JP2010/066249.

Written Opinion of the International Searching Authority issued Nov. 16, 2010 in International (PCT) Application No. PCT/JP2010/066249.

Korean Notification of Preliminary Rejection mailed Jun. 19, 2013 in corresponding Korean Patent Application No. 10-2012-7006514 with English translation.

Japanese Decision of a Patent Grant issued Dec. 3, 2013 in corresponding Japanese Patent Application No. 2009-216050 with English translation.

Australian Notice of Acceptance issued Dec. 12, 2013 in corresponding Australian Patent Application No. 2010296349.

*Primary Examiner* — Kaity Handal

(74) *Attorney, Agent, or Firm* — Wenderoth, Lind & Ponack, L.L.P.

(57) ABSTRACT

A slag monitoring device 100 for a coal gasifier includes a slag hole camera 11 that observes a slag hole 3 from which molten slag flows out, a water surface camera 12 that observes a situation in which the slag flowing out from the slag hole 3 falls onto a water surface 5H of cooling water 5, a falling sound sensor 13 that observes a sound of the slag falling onto the water surface 5H, and a processing device 20 that determines a solidification and adhesion position of the slag based on an opening area of the slag hole 3 observed by the slag hole camera 11 and falling lines and falling positions of the slag observed by the water surface camera.

10 Claims, 13 Drawing Sheets

| MONITORING UNIT | REGION | EVALUATION PARAMETER |
|---|---|---|
| SLAG HOLE (3) | ROI(1) | HIGH LUMINANCE AREA |
| | | LOW LUMINANCE AREA |
| | ROI(2) | HIGH LUMINANCE AREA OF OPENING |
| | SLAG LINE DETECTION POSITION | NUMBER OF SLAG LINES |
| WATER SURFACE (5H) | ROI(3) | VARIATION AMOUNT OF LUMINANCE |
| | | LOW LUMINANCE AREA |
| | ROI(4) | HIGH LUMINANCE AREA |
| | ROI(5) | HIGH LUMINANCE AREA |
| | SLAG LINE DETECTION POSITION | NUMBER OF SLAG LINES |

SLAG MONITORING DEVICE FOR COAL GASIFIER AND COAL GASIFIER

FIELD

The present invention relates to monitoring of a discharge state of slag, which is discharged from a combustor of a coal gasifier.

BACKGROUND

There has been a technique that enables to drive a gas turbine with coal gas obtained by gasifying coal, thereby generating power. To gasify the coal, a coal gasifier is used. When the coal is gasified, slag is left as burnt embers in the coal gasifier. This slag needs to be discharged from the coal gasifier. Because the slag has fluidity when it has a sufficiently high temperature, the slag is generally discharged continuously from a slag hole provided in a lower part of the coal gasifier. A slag discharge tube filled with cooling water is provided below the slag hole, so that the slag is cooled by the cooling water and solidified, and then discharged from the slag discharge tube.

It is important in the operation of the coal gasifier to avoid such a situation that the slag hole is blocked by solidified slag or the flow of the slag becomes unstable. Therefore, to operate the coal gasifier normally, the discharge state of the slag needs to be monitored. For example, Patent Literature 1 discloses a method of monitoring molten slag generated in a gasification fusion furnace. In this method, molten slag flowing down from a slag discharge port is imaged, and when a plurality of separated or branched portions are confirmed in a lower part of the slag flow extracted from the image, it is determined that deposited and solidified slag is generated, which may block the slag discharge hole, so that a solidified-slag removing unit is operated.

CITATION LIST

Patent Literature

Patent Literature 1: Japanese Patent Application Laid-open No. 2002-295824

SUMMARY

Technical Problem

When deposition of the slag occurs in the slag hole, a slag melting burner can be activated to melt the slag. However, if the slag is deposited at a position away from the slag hole, the deposited slag cannot be melted by the slag melting burner. In this case, the slag melting burner is vainly used, which may lead to a decrease in durability of the slag melting burner and an increase in fuel consumption thereof. In Patent Literature 1, such problems have not been taken into consideration, and there is room for improvement. The present invention has been achieved to solve the above problems, and it is an object of the present invention to achieve at least one of suppression of the decrease in durability and the increase in fuel consumption of the slag melting burner, and improvement of reliability and enhancement of determination of a discharge state due to complexity of determination information in a slag monitoring device in a coal gasifier.

Solution to Problem

According to an aspect of the present invention, a slag monitoring device for a coal gasifier includes: a slag-hole observing unit that observes a slag hole from which molten slag flows out; a water-surface observing unit that observes a situation in which the slag flowing out from the slag hole falls onto a water surface of cooling water; and a processing device that determines a solidification and adhesion position of the slag based on an opening area of the slag hole observed by the slag-hole observing unit, and falling lines and falling positions of the slag observed by the water-surface observing unit.

According to the present invention, the solidification and adhesion position of the slag is determined based on the opening area of the slag hole observed by the slag-hole observing unit and falling lines and falling positions of the slag observed by the water-surface observing unit. Accordingly, when the slag is solidified and adheres to a position where the slag cannot be removed even by using a slag melting burner, determination to remove the slag without using the slag melting burner can be achieved. As a result, in the coal gasifier, unnecessary use of the slag melting burner can be avoided, thereby enabling to suppress a decrease in durability and an increase in fuel consumption of the slag melting burner. Further, improvement of reliability and enhancement of determination of a discharge state due to complexity of determination information in the slag monitoring device can be achieved.

Advantageously, in the slag monitoring device for a coal gasifier, the processing device determines that the solidification and adhesion position is at the slag hole when there is a predetermined number of falling lines of the slag and when the falling lines are at predetermined slag falling positions, respectively, and ignites a slag melting burner for melting the slag solidified and adhering to the slag hole. Accordingly, in the coal gasifier, unnecessary use of the slag melting burner can be avoided, and thus the decrease in durability and the increase in fuel consumption of the slag melting burner can be suppressed.

Advantageously, the slag monitoring device for a coal gasifier further includes a slag-falling-sound observing unit that observes a sound of the slag falling onto the water surface. When at least one of the slag-hole observing unit, the water-surface observing unit, and the slag-falling-sound observing unit fails, the processing device continues monitoring of the slag based on information obtained from the unit normally operating. Accordingly, even if a malfunction occurs in devices that obtain information required at the time of monitoring the flow state of the slag, the operation of the coal gasifier can be continued.

Advantageously, in the slag monitoring device for a coal gasifier, an underwater-slag observing unit including at least one wave transmitting sensor that transmits a detection wave toward the water onto which the slag falls and a plurality of wave receiving sensors that receive the detection wave transmitted by the wave transmitting sensor is provided below the slag-falling-sound observing unit, and the processing device evaluates deposition of solidified slag in the cooling water, based on the detection wave detected by the wave receiving sensors. Accordingly, deposition of the solidified slag can be determined accurately.

Advantageously, in the slag monitoring device for a coal gasifier, the number of the wave transmitting sensors is one, which moves downward from the water surface of the cooling water and transmits the detection wave at predetermined positions. Accordingly, the number of wave transmitting sensors can be reduced and thus the manufacturing cost of the slag monitoring device for a coal gasifier can be reduced.

Advantageously, in the slag monitoring device for a coal gasifier, an underwater-slag observing unit including a first wave transmitting/receiving sensor and a second wave transmitting/receiving sensor that can transmit and receive a detection wave is provided below the slag-falling-sound observing unit, and the processing device changes over a relation of transmission and reception between the first wave transmitting/receiving sensor and the second wave transmitting/receiving sensor to evaluate deposition of solidified slag in the cooling water based on a detected path of the detection wave. Accordingly, accuracy at the time of estimating the size of the solidified slag can be improved.

Advantageously, in the slag monitoring device for a coal gasifier, when a malfunction occurs in the slag-falling-sound observing unit, a sound generated when the slag falls onto the water surface is observed by the underwater-slag observing unit. Accordingly, even if a malfunction occurs in the slag-falling-sound observing unit, monitoring of the flow state of the slag can be continued. Consequently, possibility of stop of the operation of the coal gasifier can be reduced.

Advantageously, in the slag monitoring device for a coal gasifier, the slag-hole observing unit is a camera, and the processing device sets a gain of the camera to an automatic adjustment mode and sets a shutter speed of the camera to a maximum or arbitrary value during a period in which an activation burner of the coal gasifier is being ignited, and sets the gain and the shutter speed of the camera to fixed values during loading of coal. Accordingly, luminance can be compared and thus the flow state of the slag can be monitored more reliably at the time of gasification of the coal.

Advantageously, in the slag monitoring device for a coal gasifier, the processing device determines dirt of a light entrance portion of the slag-hole observing unit based on luminance of an image obtained by the slag-hole observing unit, and when the dirt of the light entrance portion is not allowable, the processing device activates a cleaning unit that cleans the light entrance portion. Accordingly, stable monitoring of the flow state of the slag can be realized.

Advantageously, in the slag monitoring device for a coal gasifier, the processing device determines dirt of a light entrance portion of the water-surface observing unit based on luminance of an image obtained by the water-surface observing unit, and when the dirt of the light entrance portion is not allowable, the processing device activates a cleaning unit that cleans the light entrance portion. Accordingly, stable monitoring of the flow state of the slag can be realized.

According to another aspect of the present invention, a slag monitoring device for a coal gasifier includes the slag monitoring device for a coal gasifier according to any one of described above. Because the coal gasifier includes the slag monitoring device for a coal gasifier described above, unnecessary use of the slag melting burner can be avoided to suppress the decrease in durability and the increase in fuel consumption of the slag melting burner. Further, the improvement of reliability and the enhancement of determination of a discharge state due to complexity of determination information in the slag monitoring device can be achieved.

Advantageous Effects of Invention

The present invention can achieve at least one of the suppression of the decrease in durability and the increase in fuel consumption of the slag melting burner, and the improvement of reliability and the enhancement of determination of a discharge state due to complexity of determination information in the slag monitoring device in the coal gasifier.

DESCRIPTION OF EMBODIMENTS

The present invention is explained below in detail with reference to the accompanying drawings. The present invention is not limited to the following explanations. In addition, constituent elements disclosed in the following explanations include those that can be easily assumed by persons skilled in the art, that are substantially identical, and that are within so-called equivalents.

Figure 1:
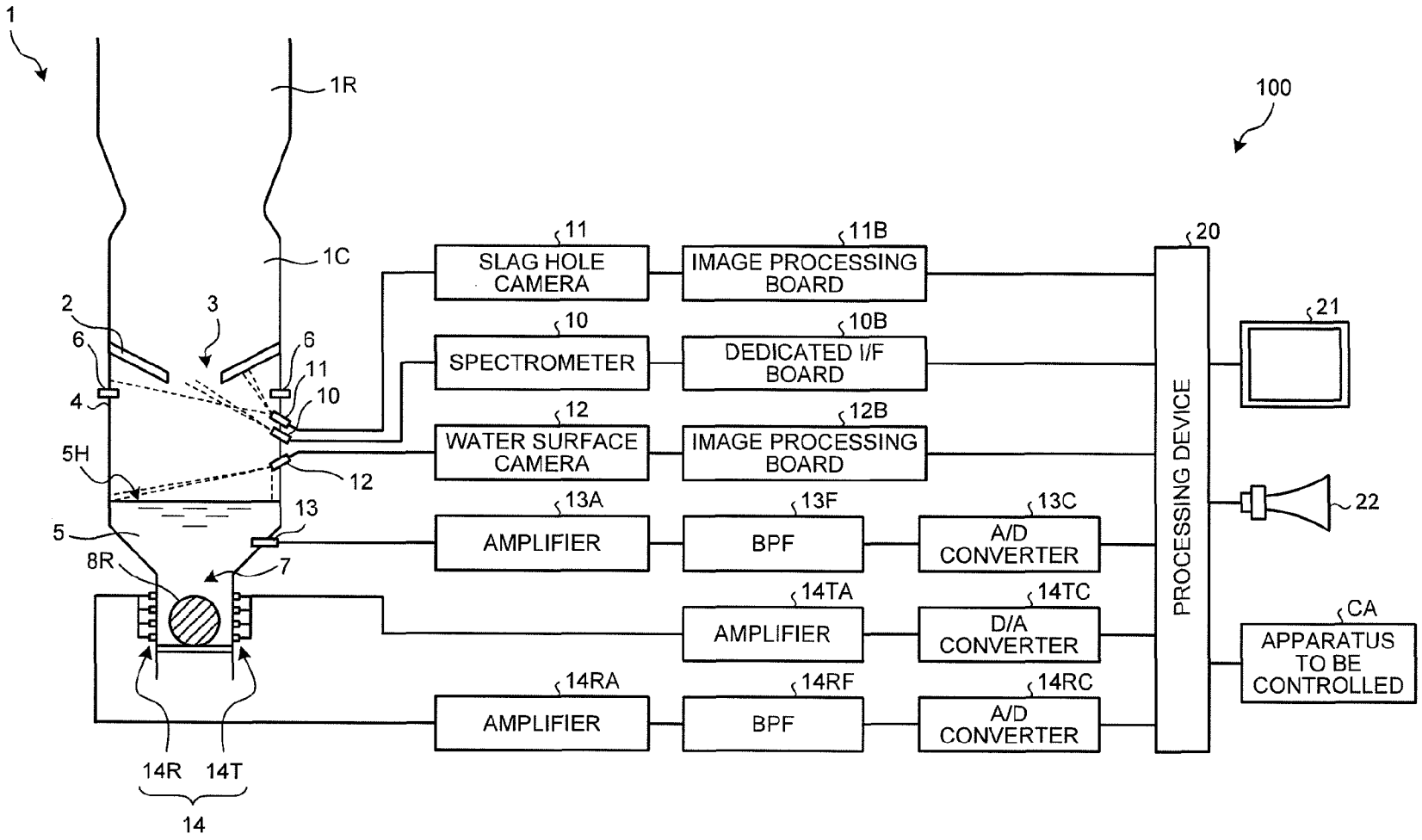
FIG. 1 is an entire configuration diagram of a slag monitoring device for a coal gasifier according to an embodiment of the present invention.

FIG. 1 is an entire configuration diagram of a slag monitoring device for a coal gasifier according to an embodiment of the present invention. A slag monitoring device 10 for a coal gasifier (hereinafter, "slag monitoring device") monitors the flow state of slag generated in a process of gasifying coal in a coal gasifier 1. Coal and a gasifying agent (air, oxygen-enriched air, $O_2$, or the like) are loaded into the coal gasifier 1. The coal gasifier 1 includes a combustor 1C that burns the coal, a reductor 1R into which the coal is loaded, thereby to gasify the coal, and a slag discharge tube 4 for collecting slag discharged from the combustor 1C. In the reductor 1R, thermal decomposition of the coal is caused due to a high temperature generated by burning the coal in the combustor 1C, and oxygen and water vapor react with carbon, so that the coal is gasified.

As shown in FIG. 1, the slag discharge tube 4 is provided in a lower part of the coal gasifier 1 (in a vertical direction). A conical slag tap 2 is provided below the combustor 1C constituting the coal gasifier 1. Slag in a molten state generated after the coal is burned in the combustor 1C and gasified in the reductor 1R is discharged via a circular slag hole 3 provided in the slag tap 2. A plurality of grooves (outflow guide grooves) for guiding outflow of discharged slag are formed (for example, two grooves are formed at positions opposite to each other with a 180-degree interval) at an edge of the slag hole 3. A sectional area of the outflow guide groove is designed in such a manner that two lines of slag flow constantly flow down. There is cooling water 5 below the slag discharge tube 4. The slag in a molten state discharged from the slag hole 3 flows down into the cooling water 5. A slag reservoir 7 (a device (a screen or the like) that separates slag having a size more than an allowable size of a device that discharges slag from the gasifier (a blowout tube, a valve, a crusher, or the like)) is provided below the slag discharge tube 4, and slag (solidified slag) 8R falling into the cooling water 5 to be solidified is stored therein.

A slag monitoring device 100 includes a first camera (hereinafter, "slag hole camera") 11 as a slag-hole observing unit, a second camera (hereinafter, "water surface camera") 12 as a water-surface observing unit, and a processing device 20. In the present embodiment, the slag monitoring device 100 also includes a spectrometer 10 as a slag-temperature measuring unit and a falling sound sensor 13 as a slag-falling-sound observing unit. The slag hole camera 11 captures an image of the slag hole 3, from which molten slag flows out and performs observation. The water surface camera 12 captures an image of molten slag having flowed out from the slag hole 3 and falling onto a water surface 5H of the cooling water 5 located below the slag discharge tube 4, and performs observation.

The falling sound sensor 13 observes a sound generated when the slag falls onto the water surface 5H of the cooling water 5. The processing device 20 includes a computer, for example, and determines a position where the slag is solidified and adheres (solidification and adhesion position) based on an opening area of the slag hole 3 observed by the slag hole camera 11 and a falling line and a falling position of the slag onto the water surface 5H observed by the water surface camera 12. A monitoring unit that monitors the slag (the slag hole camera 11, the water surface camera 12, and the like), a display 21 as a display unit, a speaker 22 as a sound generating unit, and an apparatus CA to be controlled are connected to the processing device 20.

The slag hole camera 11 is provided outside a side wall of the slag discharge tube 4. The slag hole camera 11 captures images of the slag hole 3 and a periphery of the slag hole 3 through a slag-hole monitoring window provided on the side wall of the slag discharge tube 4, thereby generating a slag hole image. The spectrometer 10 is provided outside the side wall of the slag discharge tube 4. The spectrometer 10 has a field of view in a central part (a minute region) of the slag hole 3, and measures the temperature of the central part of the slag hole 3 through the slag-hole monitoring window. The water surface camera 12 is provided outside the side wall of the slag discharge tube 4. The water surface camera 12 captures an image of the water surface 5H of the cooling water 5 through a water-surface monitoring window provided on the side wall of the slag discharge tube 4, thereby generating an image of the water surface.

The falling sound sensor 13 as the slag-falling-sound observing unit is provided below the surface of the cooling water 5. As the falling sound sensor 13 a hydrophone can be used, for example. The falling sound sensor 13 converts a sound input thereto to an electric signal and outputs the electric signal. The slag hole camera 11 is connected to an image processing board 11B. The image processing board 11B converts the image of the slag hole captured by the slag hole camera 11 to digital data. The image obtained in this process is referred to as a slag-hole monitoring image. The slag-hole monitoring image includes luminance distribution data of the slag hole. The luminance distribution data of the slag hole is composed of data indicating luminance of each pixel included in the slag-hole monitoring image.

The spectrometer 10 is connected to a dedicated IF board 10B. The dedicated IF board 10B generates temperature data indicating the central temperature of the slag hole 3 measured by the spectrometer 10. The water surface camera 12 is connected to an image processing board 12B. The image processing board 12B converts the image of the water surface captured by the water surface camera 12 to digital data. The image obtained in this process is referred to as a water-surface monitoring image. The water-surface monitoring image includes luminance distribution data of the water surface. The water-surface monitoring image is composed of luminance of each pixel included in the water-surface monitoring image.

An output of the falling sound sensor 13 is input to an amplifier 13A. The amplifier 13A amplifies the electric signal output from the falling sound sensor 13. An output of the amplifier 13A is input to a bandpass filter (BPF) 13F. Out of the output from the amplifier 13A, the BPF 13F allows a signal in a predetermined monitoring band including components in a band of the falling sound generated by the slag falling onto the cooling water 5 to pass therethrough and outputs the signal. An output of the BPF 13F is input to an A/D converter 13C. Out of the sound obtained by the falling sound sensor 13, the A/D converter 13C digitizes an analog signal output from the BPF 13F. The A/D converter 13C outputs digital data of the components in the predetermined monitoring band including the band of the sound generated by the slag falling onto the cooling water 5. The digital data is hereinafter referred to as underwater-sound monitoring data.

An underwater-slag observing unit 14 that observes the solidified slag 8R located in the cooling water 5 in the slag reservoir 7 is provided around the slag reservoir 7. The underwater-slag observing unit 14 is arranged below the falling sound sensor 13. In the present embodiment, the underwater-slag observing unit 14 includes a plurality of (four in the present embodiment) wave transmitting sensors 14T that transmit detection waves, and a plurality of (four in the present embodiment) wave receiving sensors 14R that receive the detection waves transmitted from the wave transmitting sensors 14T. The underwater-slag observing unit 14 observes the solidified slag 8R in the slag reservoir 7 by detecting attenuation levels of the detection waves transmitted from the wave transmitting sensors 14T using the wave receiving sensors 14R. When there is a wave receiving sensor 14R having received a detection wave largely attenuated, which has been transmitted from the wave transmitting sensor 14T, it can be determined that there is solidified slag 8R between the wave receiving sensor 14R and the wave transmitting sensor 14T that has transmitted the detection wave, by using a fact that the detection wave attenuates due to the presence of the solidified slag 8R.

An amplifier 14TA is connected to the wave transmitting sensors 14T, a D/A converter 14TC is connected to the amplifier 14TA, and the D/A converter 14TC is connected to the processing device 20. When the solidified slag 8R in the slag reservoir 7 is to be observed, the processing device 20 sends a detection-wave transmission command. With this command, a signal (a detection-wave generation signal) for generating a detection wave of a predetermined frequency (for example, an ultrasonic wave of 120 kilohertz) is generated. The detection-wave generation signal is converted to analog data by the D/A converter 14TC, amplified by the amplifier 14TA, and input to the wave transmitting sensors 14T. With this input, the wave transmitting sensors 14T transmit detection waves of a frequency corresponding to the detection-wave generation signal.

The wave receiving sensors 14R having received the detection waves transmitted from the wave transmitting sensors 14T output detection-signal reception signals. These outputs are input to an amplifier 14RA. The amplifier 14RA amplifies the electric signals output from the wave receiving sensors 14R. An output of the amplifier 14RA is input to a bandpass filter (BPF) 14RF. The BPF 14RF removes an unnecessary frequency band from the output of the amplifier 14RA and sends the output. The output from the BPF 14RF is input to an A/D converter 14RC. The A/D converter 14RC digitizes an analog signal output from the BPF 14RF and inputs a digital signal to the processing device 20. The digital data is hereinafter referred to as solidified-slag monitoring data.

The image processing board 11B, the dedicated IF board 10B, the image processing board 12B, and the A/D converter 13C are connected to the processing device 20. The processing device 20 monitors and evaluates a discharge state of the slag based on at least the luminance distribution data of the slag hole, the luminance distribution data of the water surface, and the underwater-sound monitoring data. At that time, the processing device 20 also uses temperature data, as required. The processing device 20 outputs a slag-melting-burner ignition command to ignite to operate a slag melting burner 6 (corresponding to the apparatus CA to be controlled) provided in the periphery of the slag hole 3, and also issues various warning outputs by using the display 21 and the speaker 22, when having determined that this process is necessary as a result of the monitoring and evaluation.

Figure 2:
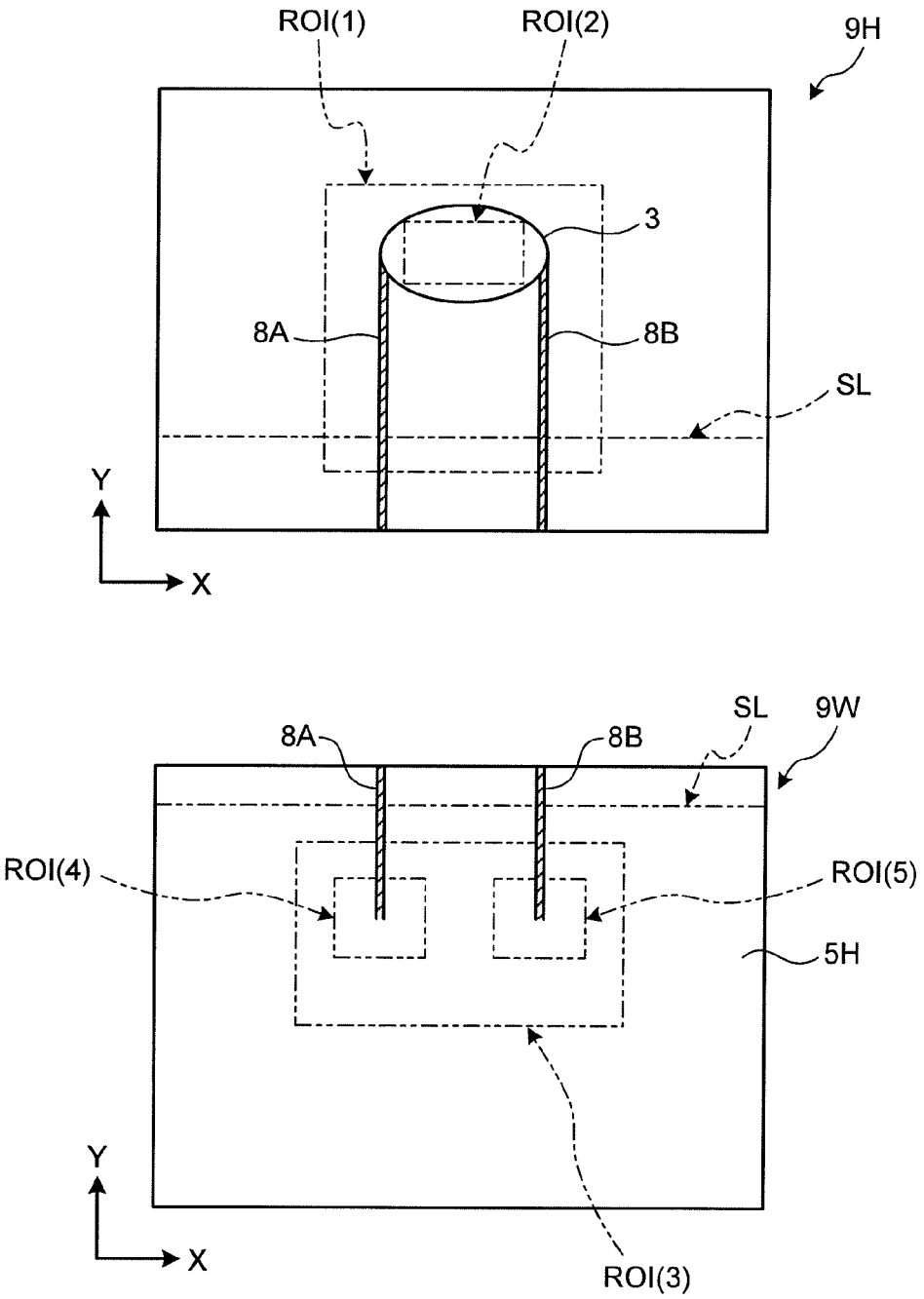
FIG. 2 is a schematic diagram of an example of images obtained by a slag hole camera and a water surface camera.
Figures 3, 4:
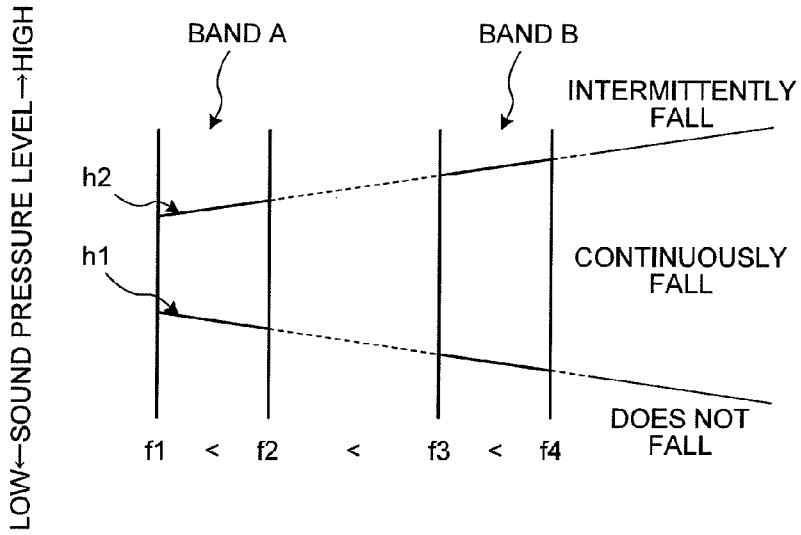
FIG. 3 is an explanatory diagram indicating correspondences between regions of interest in the images obtained by the slag hole camera and the water surface camera, and evaluation parameters.
FIG. 4 is an explanatory diagram of a method of determining a falling sound in the present embodiment.

FIG. 2 is a schematic diagram of an example of images obtained by the slag hole camera and the water surface camera. FIG. 3 is an explanatory diagram indicating correspondences between regions of interest in the images obtained by the slag hole camera and the water surface camera, and evaluation parameters. In FIG. 2, a slag-hole monitoring image 9H obtained by the slag hole camera 11 and a water-surface monitoring image 9W obtained by the water surface camera 12 are shown.

The slag-hole monitoring image 9H includes the slag hole 3 and a periphery thereof, and the water-surface monitoring image 9W includes the water surface 5H. In the slag-hole monitoring image 9H and the water-surface monitoring image 9W, regions of interest ROI(1) to ROI(5), for monitoring the flow state of the slag are set. Further, when the flow state of the slag is to be monitored, lines of the slag (slag lines) 8A and 8B flowing down from the slag hole 3 are detected and focused. When the slag lines 8A and 8B are to be detected, the processing device 20 detects the presence and positions of the slag lines 8A and 8B based on luminance in each image at slag-line detection positions SL arranged at predetermined positions in the slag-hole monitoring image 9H and the water-surface monitoring image 9W.

In the region ROI(1), the slag hole 3 from which the slag flows out and the slag lines 8A and 8B flowing out therefrom are imaged. Therefore, states of the slag hole 3 and the slag flow immediately below the slag hole 3 are shown in the region ROI(1). The region ROI(2) is a rectangular region substantially overlapping on the slag hole 3. The state of the slag hole 3 is imaged in the region ROI(2). Therefore, the state of the slag hole 3 is shown in the region ROI(2). The slag hole camera 11 that generates the slag-hole monitoring image 9H captures an image of the slag hole 3 from an angle. Therefore, the slag hole 3 is imaged in an elliptic shape in the slag-hole monitoring image 9H.

The region ROI(3) is rectangular and is a region in which the slag falls onto the water surface 5H. The two slag lines 8A and 8B are imaged in the region ROI(3). Therefore, the state of the slag flow falling onto the water surface 5H are shown in the region ROI(3). The number of slag lines depends on the number of the outflow guide grooves described above, formed at the edge of the slag hole 3. Because two outflow guide grooves are provided in the present embodiment, two slag lines 8A and 8B flow down from the slag hole 3 when there is no malfunction.

The region ROI(4) is rectangular and is a region in which one slag line 8A falls onto the water surface 5H, out of the slag lines 8A and 8B flowing down from the slag hole 3. Therefore, the state of the one slag flow falling down onto the water surface 5H is shown in the region ROI(4). Further, the region ROI(5) is rectangular and is a region in which the other slag line 8B falls onto the water surface 5H, out of the slag lines 8A and 8B flowing down from the slag hole 3. Therefore, the state of the other slag flow falling down onto the water surface 5H is shown in the region ROI(5).

In the image on the slag hole 3 side, that is, in the slag-hole monitoring image 9H, the flow state of the slag is monitored by using evaluation parameters in the regions ROI(1) and ROI(2) and at the slag-line detection position SL. In the region ROI(1), evaluation parameters to be used at the time of monitoring the flow state of the slag are a high luminance area and a low luminance area. The high luminance area in the region ROI(1) is an area of a region in which luminance is higher than a predetermined value in the region ROI(1) specified in the slag monitoring image. The low luminance area in the region ROI(1) is an area of a region in which luminance is lower than the predetermined value in the region ROI(1) specified in the slag monitoring image.

In the region ROI(2), an evaluation parameter to be used at the time of monitoring the flow state of the slag is a high luminance area of an opening. The high luminance area of the opening in the region ROI(2) is an area of a region in which luminance is higher than a predetermined value in the region ROI(2), which is specified in the slag-hole monitoring image 9H and indicates the opening of the slag hole 3. At the slag-line detection position SL, an evaluation parameter to be used at the time of monitoring the flow state of the slag is the number of slag lines falling down from the slag hole 3.

In the image on the water surface 5H side, that is, in the water-surface monitoring image 9W, the flow state of the slag is monitored by using evaluation parameters in the regions ROI(3), ROI(4), and ROI(5), and at the slag-line detection position SL. In the region ROI(3), evaluation parameters to be used at the time of monitoring the flow state of the slag are a luminance variation coefficient and a low luminance area. The luminance variation coefficient in the region ROI(3) is an amount of variation in each processing cycle in the region ROI(3) specified in the water-surface monitoring image. The low luminance area in the region ROI(3) is an area of a region in which luminance is lower than a predetermined value in the region ROI(3) specified in the water-surface monitoring image.

In the regions ROI(4) and ROI(5), an evaluation parameter to be used at the time of monitoring the flow state of the slag is a high luminance area. The high luminance areas in the regions ROI(4) and ROI(5) are areas of regions in which luminance is higher than a predetermined value in the regions ROI(4) and ROI(5), which are specified in the water-surface monitoring image 9W and indicate regions in which the slag lines 8A and 8B fall onto the water surface 5H. At the slag-line detection position SL, an evaluation parameter to be used at the time of monitoring the flow state of the slag is the number of slag lines falling down from the slag hole 3.

FIG. 4 is an explanatory diagram of a method of determining a falling sound in the present embodiment. In the present embodiment, the processing device 20 determines whether the slag is continuously falling or intermittently falling from the slag hole 3, or the slag is not falling, based on the falling sound detected by the falling sound sensor 13. In the present embodiment, when a frequency f of the falling sound detected by the falling sound sensor 13 is within a band A or a band B, the falling state of the slag is determined based on a sound pressure of the falling sound. The frequency band of the band A is equal to or larger than f1 and equal to or smaller than f2, and the frequency band of the band B is equal to or larger than f3 and equal to or smaller than f4 (f1<f2<f3<f4).

The processing device 20 obtains the frequency f of the falling sound obtained by the falling sound sensor 13, and determines that the slag is not falling when the frequency f is within the band A or B and when the sound pressure of the falling sound is lower than a first threshold h1. When the frequency f of the falling sound is within the band A or B and when the sound pressure of the falling sound is equal to or higher than the first threshold h1 and lower than a second threshold h2, the processing device 20 determines that the slag is continuously falling. When the frequency f of the falling sound is within the band A or B and when the sound pressure of the falling sound is higher than the second threshold h2, the processing device 20 determines that the slag is intermittently falling. In the present embodiment, the first threshold h1 and the second threshold h2 increase with an increase in the frequency.

Figure 5:
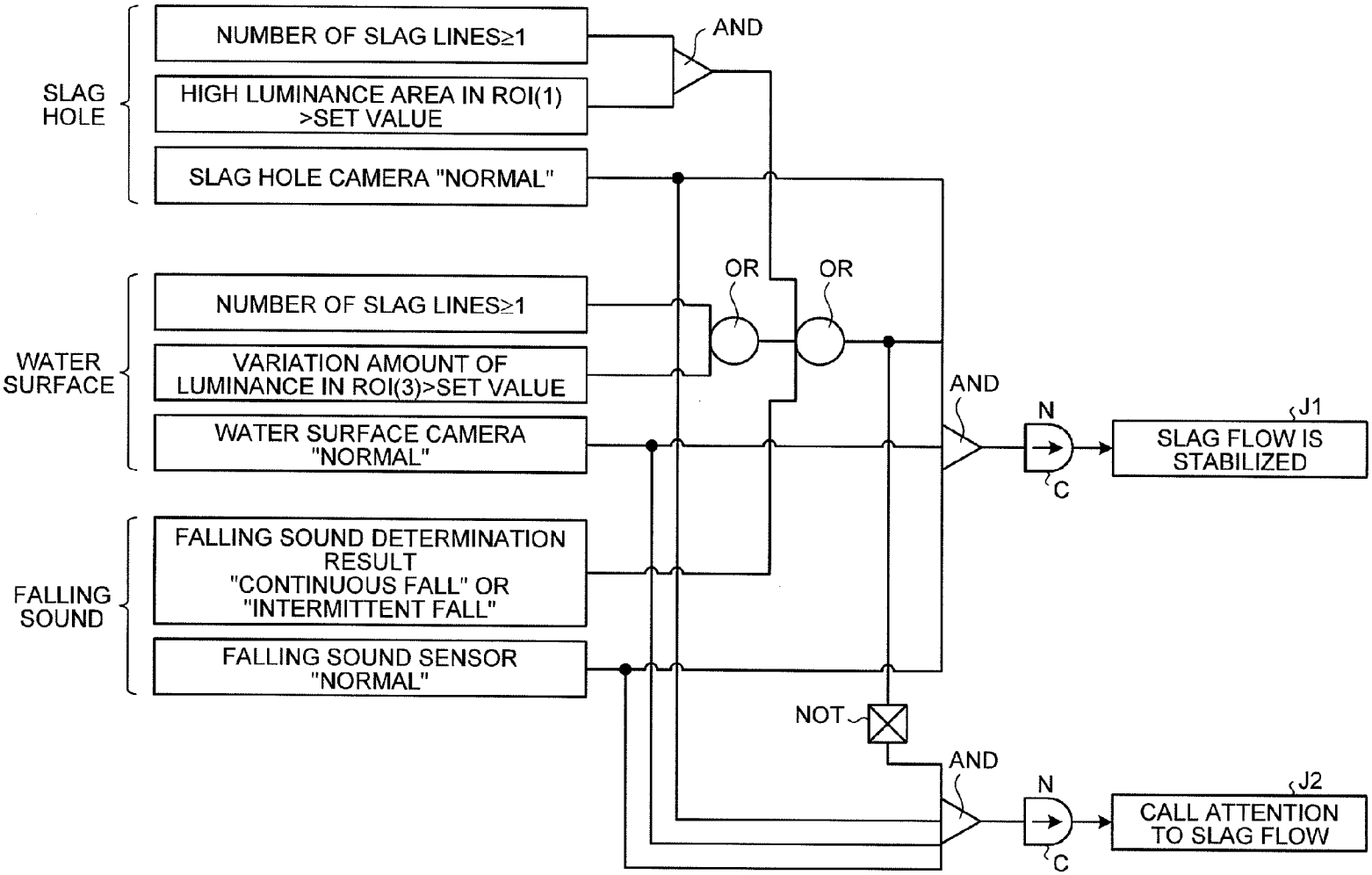
FIG. 5 is an example of an evaluation logic at the time of monitoring a flow state of slag in the present embodiment.

FIG. 5 is an example of an evaluation logic used at the time of monitoring the flow state of the slag in the present embodiment. In the present embodiment, when AND of (1) to (4) described below is repeated N times, the processing device 20 determines that the slag flow is stabilized (J1).

(1) The slag hole camera 11 normally functions.

(2) The water surface camera 12 normally functions.

(3) The falling sound sensor 13 normally functions.

(4) At least one of conditions (a), (b), and (c) is established.

The condition (a) is that the number of slag lines is more than 1 on the slag hole 3 side and the high luminance area in the region ROI (1) is larger than a set value. The condition (b) is that the falling sound is continuous or intermittent, and the condition (c) is that at least one of the number of slag lines being more than 1 on the water surface 5H side and the variation amount of luminance in the region ROI (3) being larger than a set value is established.

When AND of (1) to (3) described above and (5) described below is repeated N times, the processing device 20 determines that the slag flow tends to become unstable and calls attention to the slag flow (J2).

(5) None of the conditions (a), (b), and (c) described above is established.

When at least one of the slag hole camera 11, the water surface camera 12, and the falling sound sensor 13 malfunctions, the processing device 20 continuously monitors the flow state of the slag based on the information obtained from those normally operating. For example, when the falling sound sensor 13 malfunctions, the processing device 20 monitors the flow state of the slag by using only the information obtained from the slag hole camera 11 and the water surface camera 12, without using the information of the falling state of the slag obtained from the falling sound sensor 13 and the information about whether the falling sound sensor normally functions.

In this case, the flow state of the slag is monitored by using an evaluation logic reconstructed by eliminating the information obtained from the falling sound sensor 13 from the evaluation logic shown in FIG. 5. Likewise, when the water surface camera 12 malfunctions, the flow state of the slag is monitored by using an evaluation logic reconstructed by eliminating the information obtained from the water surface camera 12 from the evaluation logic shown in FIG. 5. Further, when both the water surface camera 12 and the falling sound sensor 13 malfunction, the flow state of the slag is monitored by using an evaluation logic reconstructed by eliminating the information obtained from the falling sound sensor 13 and the information obtained from the water surface camera 12 from the evaluation logic shown in FIG. 5.

In this way, in the present embodiment, when at least one of the slag hole camera 11, the water surface camera 12, and the falling sound sensor 13 malfunctions, the processing device 20 continuously monitors the flow state of the slag based on the information obtained from those normally operating. Accordingly, although monitoring accuracy slightly reduces, the operation of the coal gasifier 1 does not need to be stopped. Monitoring of the flow state of the slag based on the information obtained from those normally operating when at least one of the slag hole camera 11, the water surface camera 12, and the falling sound sensor 13 malfunctions is similarly performed in the following example.

[Determination of Solidification and Adhesion Position]

Figure 6:
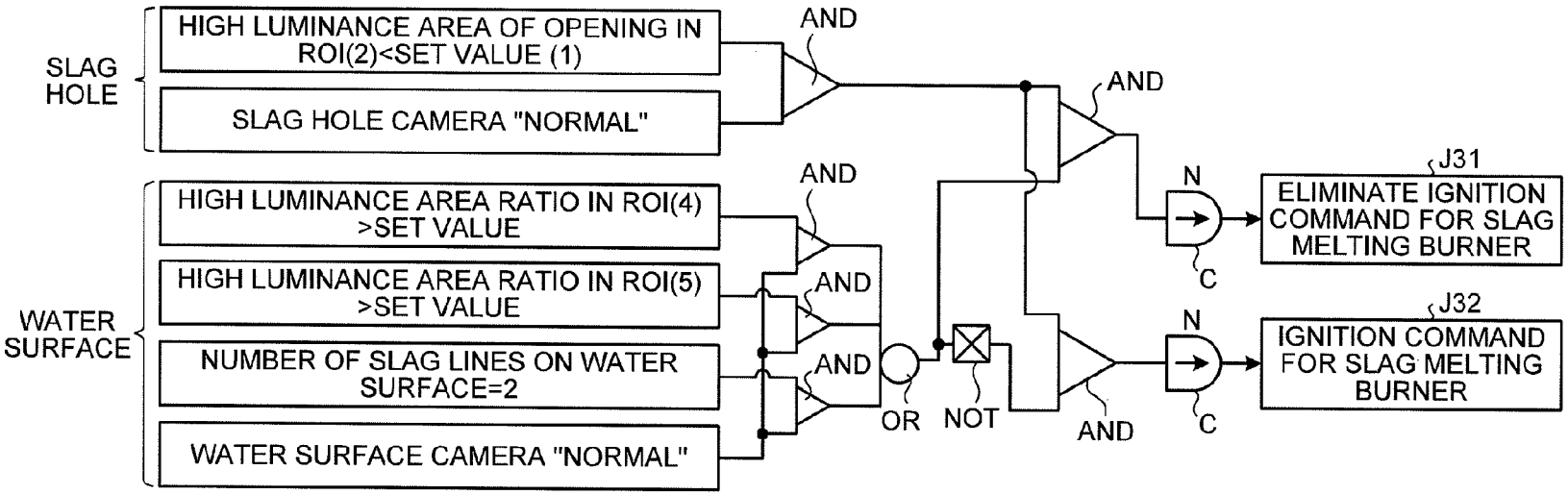
FIG. 6 depicts an evaluation logic for determining a position where slag is solidified, adheres, and is deposited.
Figure 7:
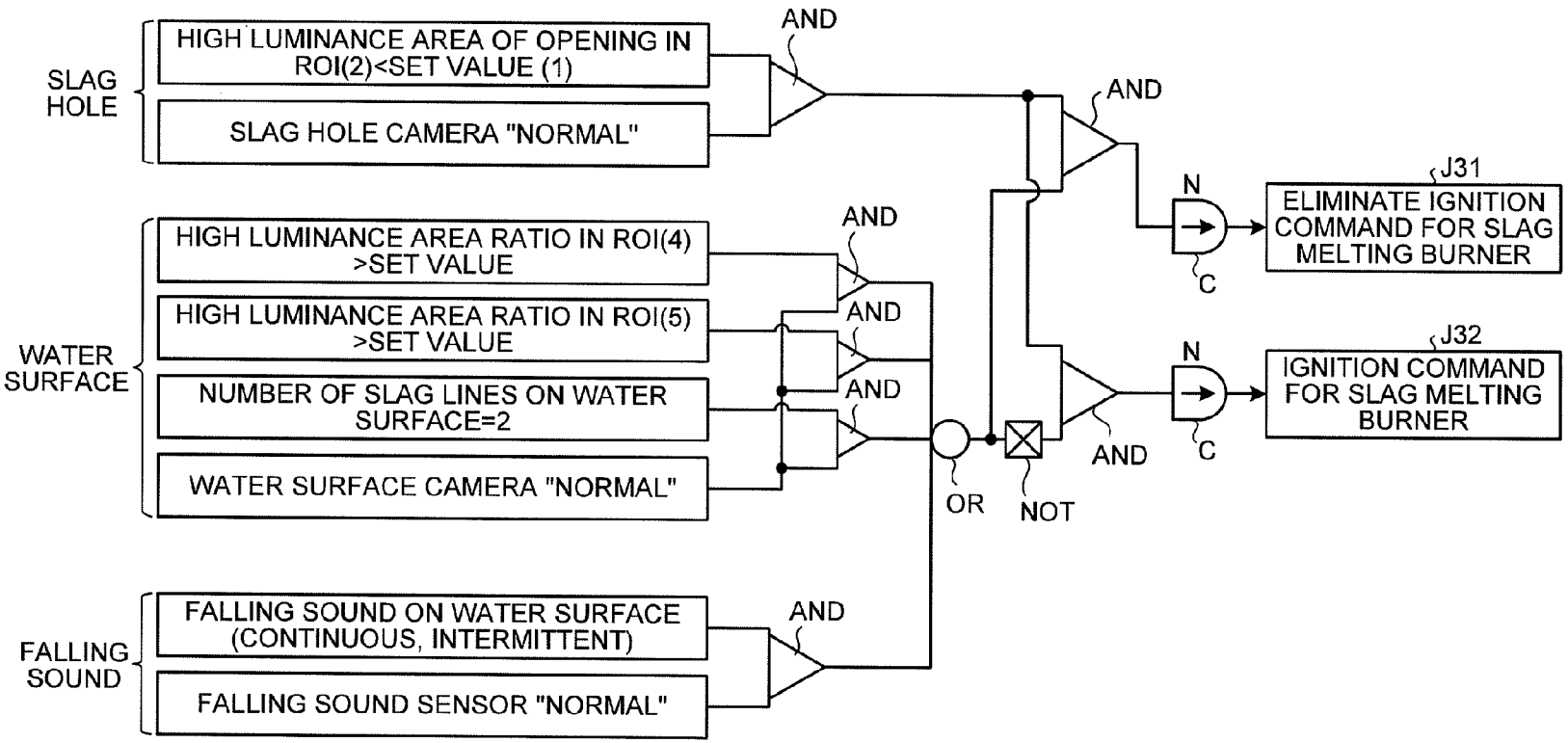
FIG. 7 depicts an evaluation logic for determining a position where slag is solidified, adheres, and is deposited.

FIGS. 6 and 7 depict an evaluation logic for determining the position where the slag is solidified, adheres, and is deposited. In the present embodiment, the processing device 20 determines the position where the slag is solidified, adheres, and is deposited (solidification and adhesion position) based on an opening area of the slag hole 3 observed by the slag hole camera 11 and falling lines and falling positions of the slag observed by the water surface camera 12. More specifically, when both of a case in which the following conditions (6) and (7) are both established and a case in which any one of conditions (8) to (10) is established are repeated N times (see FIG. 6), the processing device 20 determines that although the slag is not deposited in the slag hole 3, the slag is solidified and adheres to the periphery of the slag hole 3, and the deposited slag cannot be removed even by operating the slag melting burner 6. In this case, the processing device 20 does not transmit an ignition command for the slag melting burner 6 (J31).

Further, when both of the case in which the conditions (6) and (7) are both established and a case in which none of the conditions (8) to (10) is established are repeated N times (see FIG. 6), the processing device 20 determines that the slag is deposited in the slag hole 3, and transmits an ignition command for the slag melting burner 6 (J32).

(6) The high luminance area of the opening in the region ROI (2) is smaller than a set value (1).

(7) The slag hole camera 11 normally functions.

(8) The water surface camera 12 normally functions, and a high luminance area ratio in the region ROI (4) is larger than a set value.

(9) The water surface camera 12 normally functions, and a high luminance area ratio in the region ROI (5) is larger than a set value.

(10) The water surface camera 12 normally functions, and the number of slag lines falling onto the water surface 5H obtained by the water surface camera 12 is a predetermined value (two in the present embodiment).

The predetermined value in the condition (10) depends on the number of outflow guide grooves formed at the edge of the slag hole 3 (the same is true in the following explanations). When there is slag at an intermediate position between the monitoring window and the slag hole 3, and when the slag is flowing down from the two outflow guide grooves of the slag hole, arrival points of the slag onto the water surface are substantially fixed positions (within the region ROI (4) and the region ROI (5)). However, when the slag is deposited in the slag hole 3, flowing-down positions of the slag change and the slag flows down regardless of the outflow guide grooves, and thus the falling position of the slag onto the water surface does not become the fixed positions (within the region ROI (4) and the region ROI (5)) stochastically. Therefore, as described above, it can be determined whether the slag is deposited in the slag hole 3 or the slag is not deposited in the slag hole 3 but the slag is solidified, adheres, and is deposited in the periphery of the slag hole 3.

Further, as shown in FIG. 7, the information obtained from the falling sound sensor 13 can be added to determine the solidification and adhesion position of the slag. More specifically, when both of the case in which the conditions (6) and (7) are both established and a case in which any one of conditions (8) to (11) is established are repeated N times (see FIG. 7), the processing device 20 determines that the slag is not deposited in the slag hole 3 but the slag is solidified and adheres to the periphery of the slag hole 3, and that the deposited slag cannot be removed even by operating the slag melting burner 6. In this case, the processing device 20 does not transmit the ignition command for the slag melting burner 6 (J31). Further, when both of the case in which the conditions (6) and (7) are both established and a case in which none of the conditions (8) to (11) is established are repeated N times (see FIG. 7), the processing device 20 determines that the slag is deposited in the slag hole 3, and transmits the ignition command for the slag melting burner 6 (J32).

(11) The falling sound sensor 13 normally functions, and a falling sound detected by the falling sound sensor 13 is continuous or intermittent.

In the determination logic shown in FIG. 7, the determination by the falling sound sensor is added to the determination logic shown in FIG. 6. This is because improvement in reliability at the time of determining flowing down of the slag is taken into consideration. When flowing down of the slag onto the water surface is at the fixed positions, the falling sound responds. At that time, when the falling sound sensor 13 malfunctions, the position at which the slag is solidified, adheres, and is deposited is determined automatically by using the determination logic shown in FIG. 6.

When the processing device 20 determines that the slag is not deposited in the slag hole 3 but the slag is solidified, adheres to, and is deposited in the periphery of the slag hole 3, the processing device 20 displays this effect, for example, on the display 21. In this case, even if the slag melting burner 6 is operated, the deposited slag cannot be removed. Accordingly, for example, a place where the slag is likely to be deposited in the periphery of the slag hole 3 is investigated beforehand, and a heating unit that melts the slag is arranged in this place and is operated, thereby removing the slag deposited in the periphery of the slag hole 3.

In the present embodiment, because the solidification and adhesion position of the slag can be determined in this way, the processing device 20 can perform control in such a manner that the slag melting burner 6 is operated when the slag is deposited in the slag hole 3, and the slag melting burner 6 is not operated when the slag is deposited at a position away from the slag hole 3. Accordingly, when the slag melting burner 6 cannot melt the deposited slag, the slag melting burner 6 is not operated. Therefore, unnecessary use of the slag melting burner 6 can be avoided, and a decrease in durability and an increase in fuel consumption of the slag melting burner 6 can be suppressed.

When the solidification and adhesion position of the slag is to be determined, the processing device 20 normally uses the slag hole camera 11, the water surface camera 12, and the falling sound sensor 13 (the evaluation logic in FIG. 7) to determine the solidification and adhesion position of the slag. When the falling sound sensor 13 fails or the like, the processing device 20 can determine the solidification and adhesion position of the slag by using only the slag hole camera 11 and the water surface camera 12 (the evaluation logic in FIG. 6). In this manner, more accurate determination can be performed when the falling sound sensor 13 normally functions, and the solidification and adhesion position of the slag can be determined even if the falling sound sensor 13 malfunctions. Therefore, the coal gasifier 1 does not need to be stopped.

Figure 8:
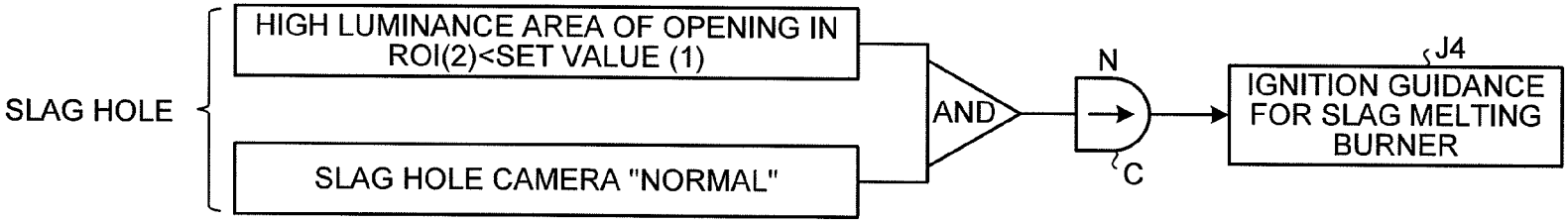
FIG. 8 depicts an evaluation logic for determining whether to operate a slag melting burner.

FIG. 8 depicts an evaluation logic for determining whether to operate the slag melting burner. As shown in FIG. 8, when a case in which conditions (12) and (13) described below are both satisfied occurs consecutively N times, the processing device 20 determines that the solidification and adhesion position of the slag is the slag hole 3, and prompts ignition of the slag melting burner 6 (J4 in FIG. 8).

(12) The high luminance area of the opening in the region ROI(2) obtained by the slag hole camera 11 is smaller than a first set value.

(13) The slag hole camera 11 normally functions.

It can be considered that the reason for the small high luminance area of the opening of the slag hole 3 is because the slag hole 3 is blocked by deposited slag, and when the high luminance area of the opening is smaller than the first set value, the processing device 20 determines that the deposition of the slag in the slag hole 3 is not allowable. In this case, the processing device 20 notifies an operator of prompting ignition of the slag melting burner 6 with the display 21 or the speaker 22. Upon reception of this notification, the operator ignites and activates the slag melting burner 6 to remove the slag deposited in the slag hole 3. In this manner, because it is notified beforehand that the slag is deposited in the slag hole 3, the coal gasifier 1 can be stably operated. Alternatively, the processing device 20 can automatically ignite and activate the slag melting burner 6 when the conditions (12) and (13) described above are satisfied consecutively N times.

Figure 9:
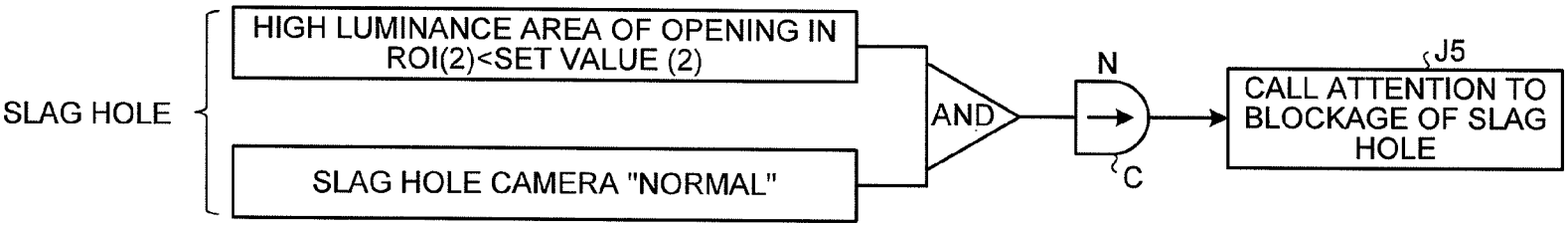
FIG. 9 depicts an evaluation logic for determining possibility of blocking a slag hole.

FIG. 9 depicts an evaluation logic for determining possibility of blocking the slag hole. As shown in FIG. 9, when a case in which all conditions (14) and (15) described below are satisfied occurs consecutively N times, the processing device 20 determines that there is the possibility of blocking the slag hole 3 (J5 in FIG. 9), and notifies the operator of this effect.

(14) The high luminance area of the opening in the region ROI (2) obtained by the slag hole camera 11 is smaller than a second set value.

(15) The slag hole camera 11 normally functions.

When the high luminance area of the opening of the slag hole 3 is smaller than the second set value, the processing device 20 determines that there is the possibility of blocking the slag hole 3. In this case, the processing device 20 notifies the operator of the possibility of blocking the slag hole 3 with the display 21 or the speaker 22. Accordingly, the operator removes the slag deposited in the slag hole 3 by changing operating conditions of the coal gasifier 1 and igniting the slag melting burner 6 to melt the slag, for example. Because it is notified beforehand that there is the possibility of blocking the slag hole 3, the coal gasifier 1 can be operated stably.

[Monitoring of Solidified Slag in Cooling Water]

Figure 10:
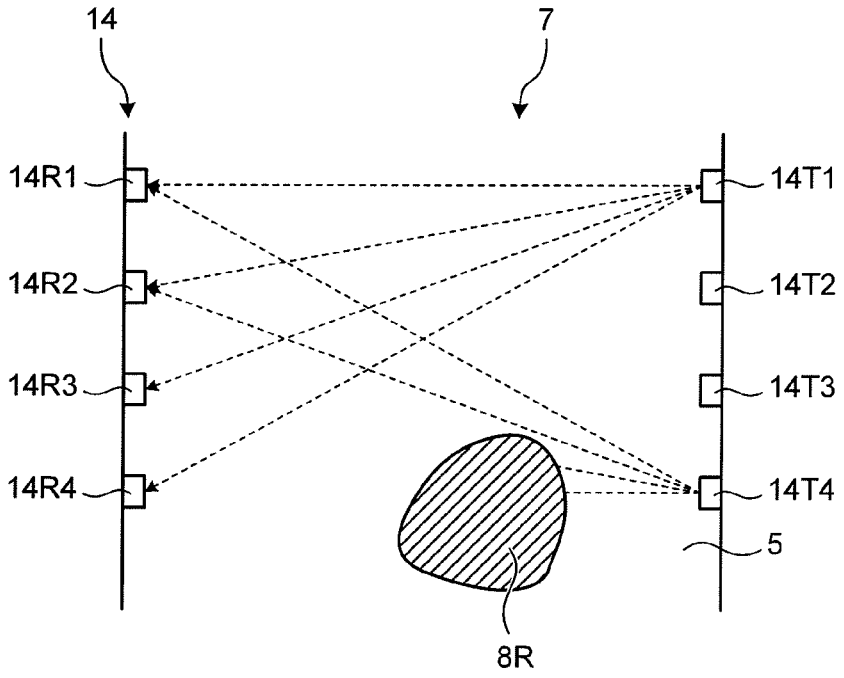
FIG. 10 is an explanatory diagram of a method of monitoring solidified slag in a slag reservoir.
Figure 11:
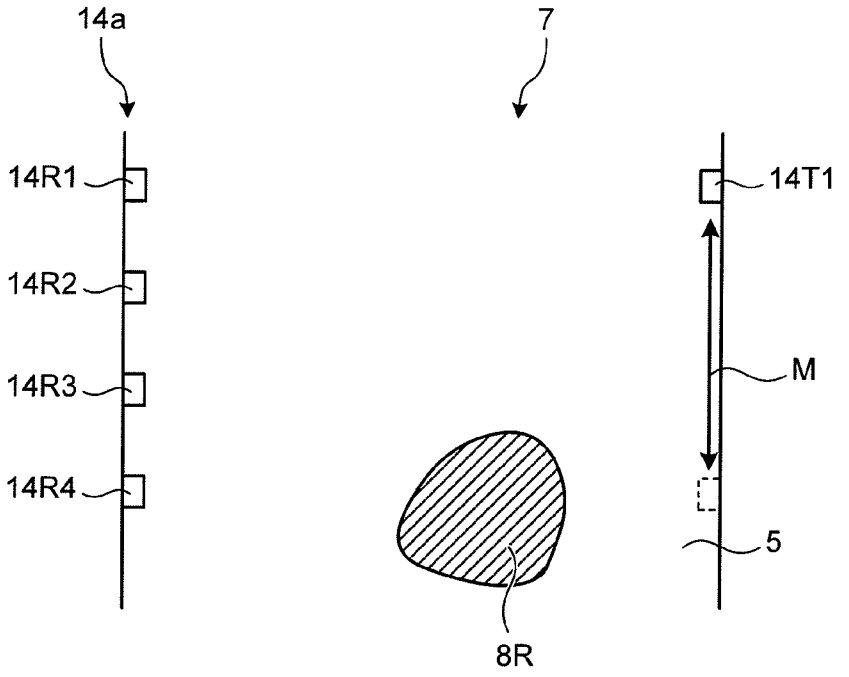
FIG. 11 is an explanatory diagram of a method of monitoring solidified slag in the slag reservoir.

FIGS. 10 and 11 are explanatory diagrams of a method of monitoring solidified slag in the slag reservoir. As described above, the solidified slag 8R in the cooling water 5 in the slag reservoir 7 is observed by the underwater-slag observing unit 14. As shown in FIG. 10, the underwater-slag observing unit 14 includes a plurality of wave transmitting sensors 14T1, 14T2, 14T3, and 14T4, and a plurality of wave receiving sensors 14R1, 14R2, 14R3, and 14R4. The processing device 20 evaluates deposition of the solidified slag 8R by the number of paths of the detection waves detected by the wave receiving sensors 14R1, 14R2, 14R3, and 14R4. In the present embodiment, the arrangement direction of the wave receiving sensors and the wave transmitting sensors is a horizontal direction. However, the direction is not limited thereto, and the wave receiving sensors and the wave transmitting sensors can be arranged in a vertical direction, or can be arranged alternately.

In the present embodiment, detection waves transmitted toward the cooling water 5 in the slag reservoir 7 by the wave transmitting sensors 14T1, 14T2, 14T3, and 14T4 are received by the wave receiving sensors 14R1, 14R2, 14R3, and 14R4. Straight lines connecting the wave transmitting sensors that have transmitted the detection waves and the wave receiving sensors that have received the transmitted detection waves are paths through which the detection waves have passed. When there is a solidified slag 8R in the slag reservoir 7, a detection wave passing through the solidified slag 8R has a larger degree of attenuation than that of a detection wave passing through a position where there is no solidified slag 8R. That is, the paths of the detection waves are intercepted by the solidified slag 8R.

Therefore, the wave transmitting sensors having received detection waves that have passed through the solidified slag 8R detect the detection waves of a lower sound pressure than the wave transmitting sensors having received detection waves that have not passed through the solidified slag 8R. This means that the presence of the solidified slag 8R can be detected according to the number of paths of the detected or intercepted detection waves. The processing device 20 can determine that there is the solidified slag 8R between a wave transmitting sensor that has transmitted a detection wave (the paths of the detection wave are detected) and a wave receiving sensor that has detected a detection wave having a lower sound pressure than other detection waves (no path of the detection wave is detected), based on the sound pressures of the detection waves detected by the wave receiving sensors. The size of the solidified slag 8R can be also presumed based on the paths of the intercepted detection waves.

In the example shown in FIG. 10, a detection wave transmitted by the wave transmitting sensor 14T1 is received by all the wave receiving sensors 14R1, 14R2, 14R3, and 14R4. Therefore, a path of the detection wave is formed between the wave transmitting sensor 14T1 and each of the wave receiving sensors 14R1, 14R2, 14R3, and 14R4. On the other hand, while a detection wave transmitted by the wave transmitting sensor 14T4 is detected by the wave receiving sensors 14R1 and 14R2, the detection wave is not detected by the wave receiving sensors 14R3 and 14R4 (or the sound pressure levels thereof are lower than that of the wave receiving sensors 14R1 and 14R2).

In this case, a path of the detection wave is formed between the wave transmitting sensor 14T4 and each of the wave receiving sensors 14R1 and 14R2; however, a path of the detection wave is not formed between the wave transmitting sensor 14T4 and each of the wave receiving sensors 14R3 and 14R4. Consequently, the processing device 20 determines based on this result that there is the solidified slag 8R between the wave transmitting sensor 14T4 and the wave receiving sensors 14R3 and 14R4, and presumes that the height (the size in a perpendicular direction) of the solidified slag 8R is smaller than the path of the detection wave formed between the wave transmitting sensor 14T4 and the wave receiving sensor 14R3.

Normally, the wave transmitting sensor has a function capable of transmitting a detection wave and also receiving a detection wave. Likewise, the wave receiving sensor has a function capable of receiving a detection wave and also transmitting a detection wave. Therefore, in the example shown in FIG. 10, the underwater-slag observing unit 14 can be configured by using the wave transmitting sensors 14T1, 14T2, 14T3, and 14T4 as first wave transmitting/receiving sensors that can transmit and receive detection waves, and using the wave receiving sensors 14R1, 14R2, 14R3, and 14R4 as second wave transmitting/receiving sensors that can transmit and receive detection waves. In this case, the processing device 20 changes over the relation of transmission and reception between the first wave transmitting/receiving sensors and the second wave transmitting/receiving sensors, and evaluates deposition of the solidified slag 8R in the cooling water 5, based on the number of paths of the detection waves detected in the respective relations.

Because the relation of transmission and reception between the wave transmitting sensors and the wave receiving sensors is fixed, the detection accuracy of the size and position of the solidified slag 8R may decrease when the solidified slag 8R is located to be nearer to the wave transmitting sensor side or the wave receiving sensor side. In this case, as described above, by using the paths of the detection waves detected by changing over the relation of transmission and reception between the first wave transmitting/receiving sensors and the second wave transmitting/receiving sensors, a decrease in the detection accuracy of the size and position of the solidified slag 8R can be suppressed.

An underwater-slag observing unit 14*a* shown in FIG. 11 evaluates deposition of the solidified slag 8R in the cooling water 5, by using one wave transmitting sensor 14T1 and the wave receiving sensors 14R1, 14R2, 14R3, and 14R4, shifting the position of the wave transmitting sensor 14T1 in a direction parallel to a vertical direction (a direction of an arrow M in FIG. 11), and causing the wave transmitting sensor 14T to transmit a detection wave at predetermined positions. For example, if the wave transmitting sensor 14T1 is shifted to the positions of the wave transmitting sensors 14T1, 14T2, 14T3, and 14T4 shown in FIG. 10 to transmit a detection wave at each position, a similar effect to that of the underwater-slag observing unit 14*a* shown in FIG. 10 can be obtained. The underwater-slag observing unit 14*a* shown in FIG. 11 needs only one wave transmitting sensor, and thus the manufacturing cost of the underwater-slag observing unit 14*a* can be reduced.

Figure 12:
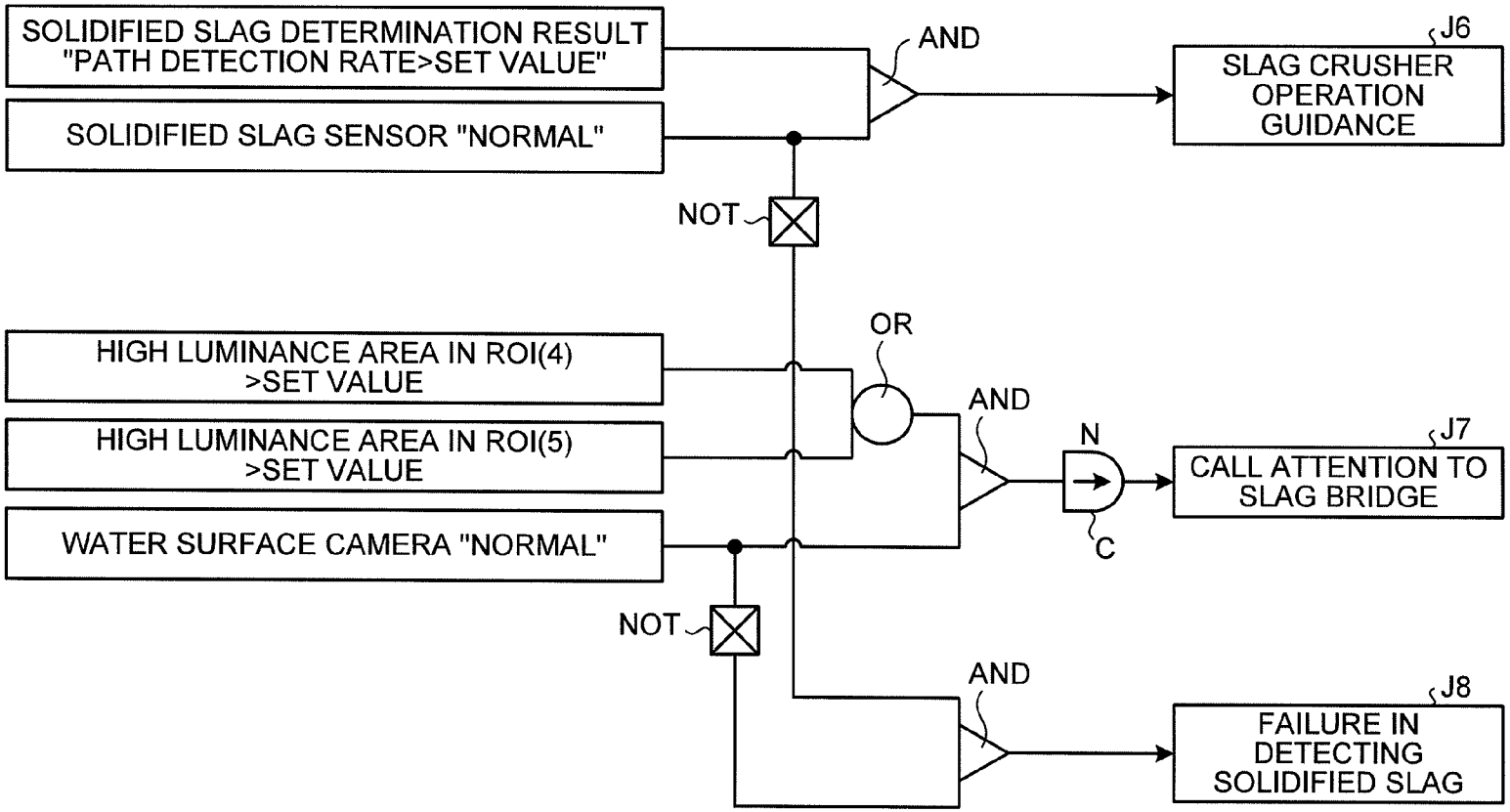
FIG. 12 depicts an evaluation logic for monitoring solidified slag in the slag reservoir.

FIG. 12 depicts an evaluation logic for monitoring a solidified slag in the slag reservoir. As shown in FIG. 12, when both of conditions (16) and (17) described below are satisfied, the processing device 20 determines it is time to crush the solidified slag 8R in the slag reservoir 7, and notifies that a slag crusher is to be operated (J6 in FIG. 12). Upon reception of the notification, the operator operates the slag crusher to crush the solidified slag 8R in the slag reservoir 7, and discharges the crushed slag from the slag reservoir 7.

(16) A detection rate of the paths detected by the underwater-slag observing unit 14 or the like (the number of wave receiving sensors 14R having detected a detection wave of a predetermined strength/the total number of wave receiving sensors 14R) is larger than a set value, and it can be determined that there is a solidified slag 8R exceeding a predetermined size in the slag reservoir 7.

(17) The underwater-slag observing unit 14 or the like normally functions.

Further, as shown in FIG. 12, if a case in which conditions (18) and (19) described below are both satisfied occurs consecutively N times, the processing device 20 determines that there is a slag bridge in the slag reservoir 7, and notifies the operator of this effect (J7 in FIG. 12).

(18) The water surface camera 12 normally functions.

(19) At least one of such conditions is established that the high luminance area in the region ROI (4) obtained by the water surface camera 12 is larger than a set value and that the high luminance area in the region ROI (5) obtained by the water surface camera 12 is larger than the set value.

Further, as shown in FIG. 12, when both of conditions (20) and (21) described below are satisfied, the processing device 20 determines that a device that detects the solidified slag 8R in the slag reservoir 7 is broken (J8 in FIG. 12). In this case, the operator repairs or replaces the broken device.

(20) The underwater-slag observing unit 14 or the like does not normally function, that is, malfunctions.

(21) The water surface camera 12 does not normally function, that is, malfunctions.

When the falling sound sensor 13 malfunctions, the processing device 20 can observe the sound of the slag falling onto the water surface 5H with the underwater-slag observing unit 14 or 14*a*. For example, because the underwater-slag observing unit 14 includes the plural wave transmitting sensors and wave receiving sensors, the underwater-slag observing unit 14 uses one of these wave transmitting sensors and wave receiving sensors as a slag-falling-sound detecting unit to detect the sound of the slag falling onto the water surface 5H. Further, although the underwater-slag observing unit 14*a* includes only one wave transmitting sensor, the one wave transmitting sensor can be used as the slag-falling-sound detecting unit and as the underwater-slag observing unit 14*a* by time-sharing. Accordingly, even if the falling sound sensor 13 malfunctions, monitoring of the flow state of the slag can be continued, thereby enabling to reduce the possibility of stopping the operation of the coal gasifier 1.

[Changeover of Gain and Shutter Speed of Camera]

Figure 13:
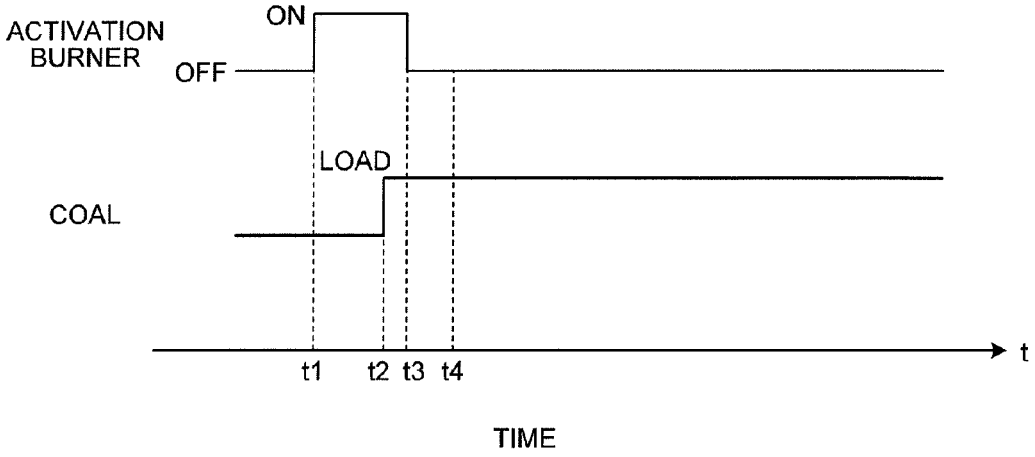
FIG. 13 is an explanatory diagram of changeover timing of a gain and a shutter speed of the slag hole camera.

FIG. 13 is an explanatory diagram of changeover timing of a gain and a shutter speed of the slag hole camera. In the present embodiment, the gain and the shutter speed of the slag hole camera 11 as the slag-hole observing unit are changed over as described below according to conditions. That is, during a period in which an activation burner of the coal gasifier 1 is being ignited (between t1 and t3 in FIG. 13), the processing device 20 sets the gain of the slag hole camera 11 to an automatic adjustment mode, and the shutter speed of the slag hole camera 11 to a maximum or arbitrary value.

During a period in which coal is loaded into the coal gasifier 1 (at t2 and thereafter in FIG. 13), the processing device 20 sets the gain and the shutter speed of the slag hole camera 11 to fixed values. More specifically, at a point in time when predetermined time has passed (t=t4) after extinguishing of the activation burner (t=t3), the gain and the shutter speed of the slag hole camera 11 are changed over to the fixed values. The reason why predetermined time is provided is to wait for combustion of coal in the combustor 1C to be stabilized.

In the example shown in FIG. 13, when loading of the coal is started and the activation burner is extinguished, the gain and the shutter speed of the slag hole camera 11 are changed over to the fixed values. When the coal is loaded after the activation burner is extinguished, the gain and the shutter speed of the slag hole camera 11 can be changed over to the fixed values after loading of the coal is started.

When the loading of the coal is started, the coal gasifier 1 starts to generate coal gas, and thus slag is formed. Therefore, the flow state of the slag needs to be monitored. In this case, when the gain and the shutter speed of the slag hole camera that observes the slag hole 3 are changed automatically, luminance change cannot be evaluated. Therefore, when the flow state of the slag is to be monitored, the gain and the shutter speed of the slag hole camera 11 are changed over to the fixed values. Accordingly, the flow state of the slag can be monitored reliably and accurately. The gain and the shutter speed of the water surface camera 12 can be also changed as in the slag hole camera 11.

[Cleaning]

Figure 14:
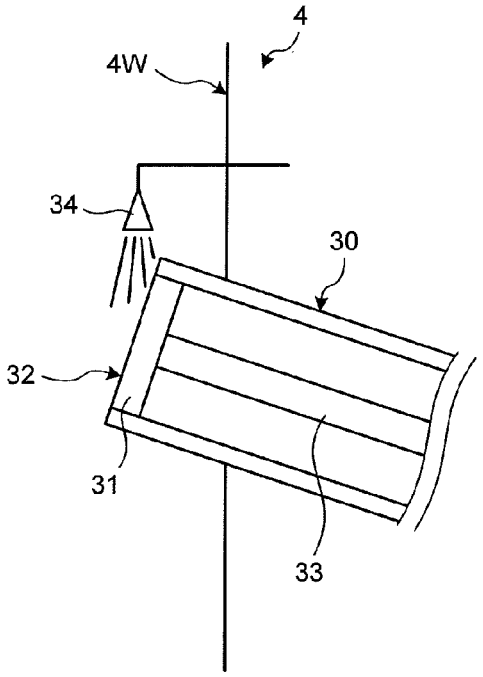
FIG. 14 is a schematic diagram of a configuration when the slag hole camera and the water surface camera monitor inside of a slag discharge tube.

FIG. 14 is a schematic diagram of a configuration when the slag hole camera and the water surface camera monitor the inside of the slag discharge tube. As shown in FIG. 14, a protective tube 30 for monitoring the slag hole 3 and the water surface 5H protrudes from a wall surface 4W of the slag discharge tube 4. On an inner side of the slag discharge tube 4 of the protective tube 30, the slag hole camera 11, the water surface camera 12, or a monitoring window 31 as a light entrance portion of the spectrometer 10 is installed, and an optical fiber 33 is arranged inside thereof (on the protective tube 30 side). The optical fiber 33 is extended to the slag hole camera 11, the water surface camera 12, or the light reception portion of the spectrometer 10. In this manner, the slag hole camera 11, the water surface camera 12, or the spectrometer 10 monitors the inside of the slag discharge tube 4 via the monitoring window 31 and the optical fiber 33.

A surface 32 of the monitoring window 31 arranged inside of the slag discharge tube 4 is likely to be dirty due to the slag, dust, and the like. Therefore, a cleaning solution (for example, water) is regularly sprayed from a cleaning nozzle 34 to the monitoring window 31 to clean the surface 32 of the monitoring window 31. Accordingly, the flow state of the slag in the slag discharge tube 4 can be monitored reliably and stably by the slag hole camera 11, the water surface camera 12, or the spectrometer 10. In the present embodiment, as described below, the processing device 20 determines dirt of the slag hole camera 11, the water surface camera 12, or the light entrance portion of the spectrometer 10 in the combustor 10 based on the luminance of an image obtained by the slag hole camera 11 or the water surface camera 12. The cleaning nozzle 34 can have a configuration that is integrally formed with the protective tube 30 fitted with the monitoring window 31. Preferably, normal-temperature sealing gas is injected to the surface 32 of the monitoring window 31, and when dirt of the surface 32 is detected, the cleaning solution is sprayed from the cleaning nozzle 34 to perform cleaning. It is effective to eject purge gas for removing remaining solution inside the cleaning nozzle 34 and on the surface 32 of the monitoring window 31 after cleaning. The purge gas can be used in common with a sealing gas nozzle.

Figure 15:
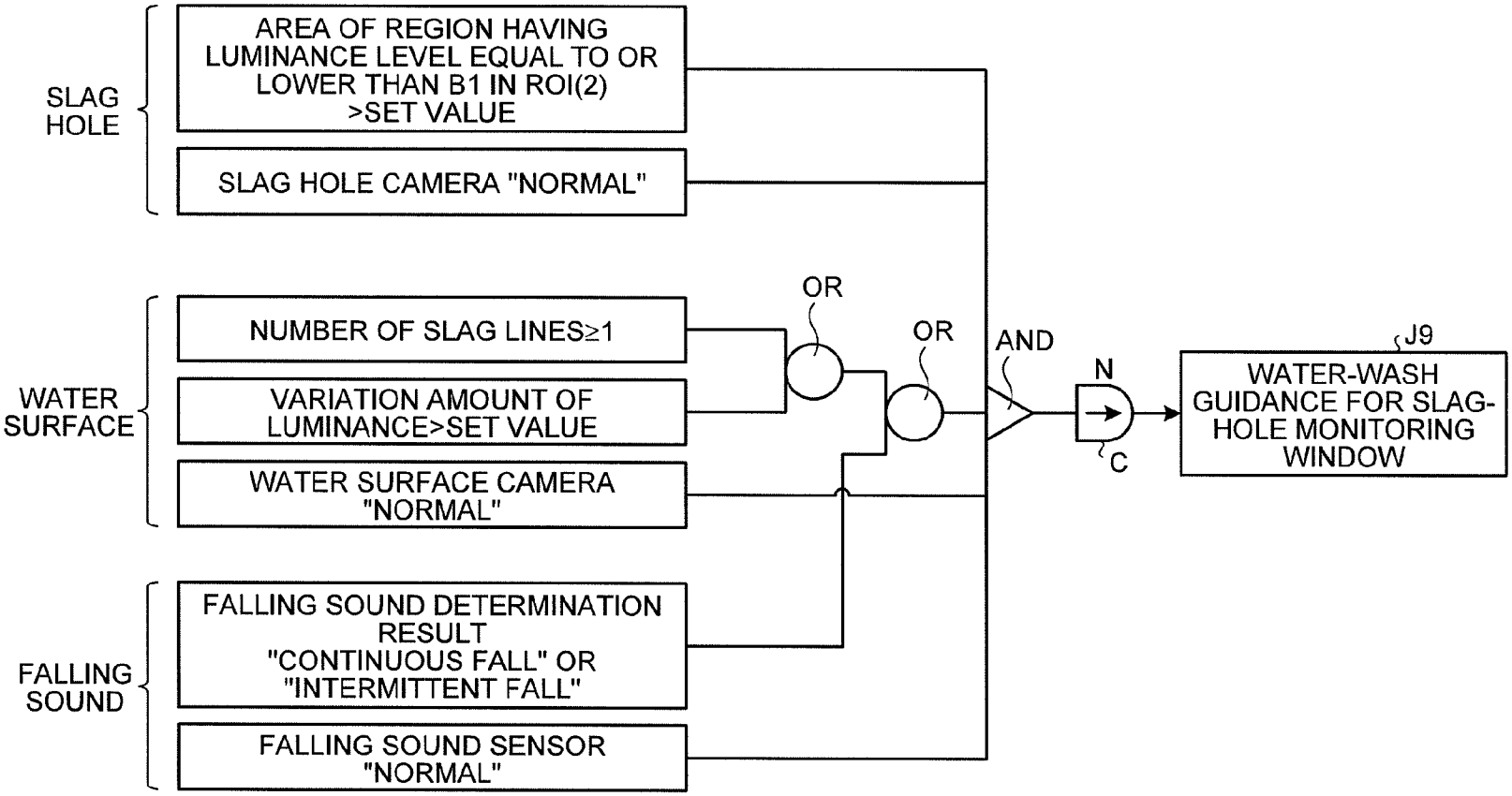
FIG. 15 depicts an evaluation logic for determining to clean a monitoring window.
Figure 16:
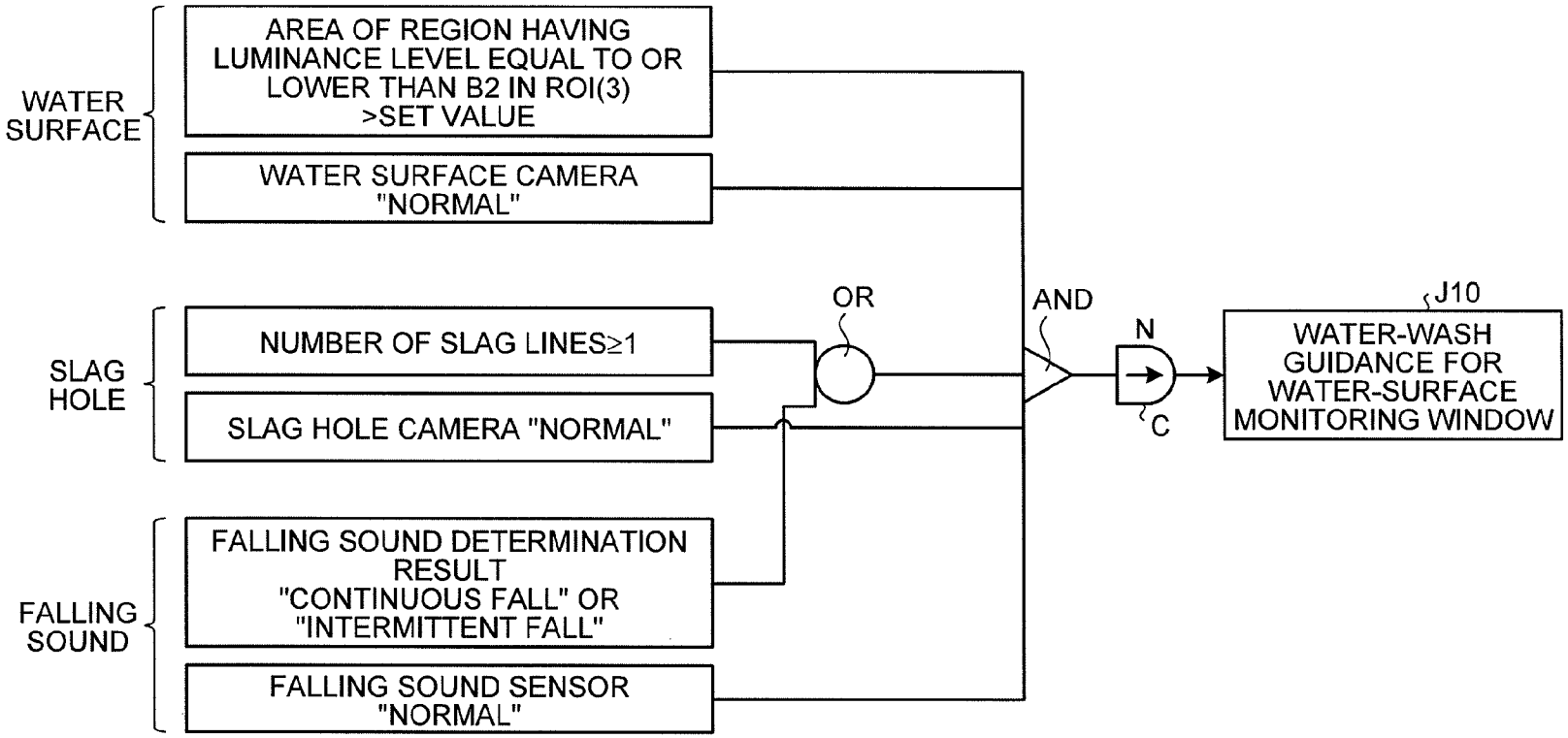
FIG. 16 depicts an evaluation logic for determining to clean the monitoring window.

FIGS. 15 and 16 depict an evaluation logic for determining whether to clean the monitoring window. As shown in FIG. 15, if a state in which all conditions (22) to (26) described below are satisfied occurs consecutively N times, the processing device 20 determines that it is time to clean the monitoring window of the slag hole camera 11, and notifies the operator of this effect with the display 21 or the speaker 22 (J9 in FIG. 15). In this case, the operator operates the cleaning nozzle for cleaning the monitoring window of the slag hole camera 11, to clean the monitoring window. Alternatively, when the processing device 20 determines that it is time to clean the monitoring window of the slag hole camera 11, the processing device 20 can operate the cleaning nozzle for cleaning the monitoring window of the slag hole camera 11 to clean the monitoring window.

(22) In the region ROI (2) obtained by the slag hole camera 11, an area of a region in which the luminance is equal to or lower than a predetermined value is larger than a set value.

(23) The slag hole camera 11 normally functions.

(24) At least one of conditions (d) and (e) described below is established. The condition (d) is that at least one of the following conditions is established, that is, the number of slag lines detected by the slag hole camera 11 is larger than 1, and a variation amount of luminance in the region ROI(3) obtained by the water surface camera is larger than a set value. The condition (e) is that the falling sound of slag detected by the falling sound sensor 13 is continuous or intermittent.

(25) The water surface camera 12 normally functions.

(26) The falling sound sensor 13 normally functions.

Further, as shown in FIG. 16, if a state in which all conditions (27) to (31) described below are satisfied occurs consecutively N times, the processing device 20 determines that it is time to clean the monitoring window of the water surface camera 12, and notifies the operator of this effect with the display 21 or the speaker 22 (J10 in FIG. 16). In this case, the operator operates the cleaning nozzle for cleaning the monitoring window of the water surface camera 12 to clean the monitoring window. Alternatively, when the processing device 20 determines that it is time to clean the monitoring window of the water surface camera 12, the processing device 20 can operate the cleaning nozzle for cleaning the monitoring window of the water surface camera 12 to clean the monitoring window.

(27) In the region ROI (3) obtained by the water surface camera 12, an area of a region in which the luminance is equal to or lower than a predetermined value is larger than a set value.

(28) The water surface camera 12 normally functions.

(29) At least one of conditions described below is established. The conditions are that the number of slag lines detected by the slag hole camera 11 is larger than 1, and that the falling sound of the slag detected by the falling sound sensor 13 is continuous or intermittent.

(30) The slag hole camera 11 normally functions.

(31) The falling sound sensor 13 normally functions.

In the present embodiment, a solidification and adhesion position of the slag is determined based on the opening area of the slag hole observed by the slag-hole observing unit and the falling lines and falling positions of the slag observed by the water-surface observing unit. Accordingly, when the slag is solidified and adheres to a position where the slag cannot be removed even by using the slag melting burner, unnecessary use of the slag melting burner can be avoided. As a result, in the coal gasifier, a decrease in durability and an increase in fuel consumption of the slag melting burner can be suppressed.

INDUSTRIAL APPLICABILITY

As described above, the slag monitoring device for a coal gasifier and the coal gasifier according to the present invention are useful in monitoring a discharge state of slag discharged from a combustor of the coal gasifier.

REFERENCE SIGNS LIST

1 coal gasifier
1C combustor
1R reductor
2 slag tap
3 slag hole
4 slag discharge tube
4W wall surface
5 cooling water
5H water surface
6 slag melting burner
8A, 8B slag line
8R solidified slag
10 spectrometer
10B dedicated I/F board
11 slag hole camera (first camera)
11B, 12B image processing board
12 water surface camera (second camera)
13 falling sound sensor
13A amplifier
13C, 14RC A/D converter
14, 14*a* underwater-slag observing unit
14R, 14R1, 14R2, 14R3, 14R4 wave receiving sensor
14T, 14T1, 14T2, 14T3, 14T4 wave transmitting sensor
14RA, 14TA amplifier
14TC D/A converter
20 processing device
21 display
22 speaker
30 protective tube
31 monitoring window
32 surface
33 optical fiber
34 cleaning nozzle
100 slag monitoring device

The invention claimed is:

1. A slag monitoring device for a coal gasifier the slag monitoring device, comprising:

a slag-hole observing unit that observes a slag hole from which molten slag flows out;

a water-surface observing unit that observes a situation in which the slag flowing out from the slag hole falls onto a water surface of cooling water;

a slag-falling-sound observing unit that observes a sound of the slag falling onto the water surface;

an underwater-slag observing unit provided below the slag-falling-sound observing unit, the underwater-slag observing unit including at least one wave transmitting sensor that transmits a detection wave toward the water onto which the slag falls and a plurality of wave receiving sensors that receive the detection wave transmitted by the wave transmitting sensor; and a processing device that determines a solidification and adhesion position of the slag based on an opening area of the slag hole observed by the slag-hole observing unit, and falling lines and falling positions of the slag observed by the water-surface observing unit, and evaluates deposition of solidified slag in the cooling water, based on the detection wave detected by the wave receiving sensors.

2. The slag monitoring device for a coal gasifier according to claim 1, wherein the processing device determines that the solidification and adhesion position is at the slag hole when there is a predetermined number of falling lines of the slag and when the falling lines are at predetermined slag falling positions, respectively, and ignites a slag melting burner for melting the slag solidified and adhering to the slag hole.

3. The slag monitoring device for a coal gasifier according to claim 1, wherein the slag-falling-sound observing unit is to be provided below the water surface of the cooling water, and when at least one of the slag-hole observing unit, the water-surface observing unit, and the slag-falling-sound observing unit fails, the processing device continues monitoring of the slag based on information obtained from a remainder of the slag-hole observing unit, the water-surface observing unit, and the slag falling-sound observing unit normally operating.

4. The slag monitoring device for a coal gasifier according to claim 1, wherein the number of the wave transmitting sensors is one, which moves downward from the water surface of the cooling water and transmits the detection wave at predetermined positions.

5. The slag monitoring device for a coal gasifier according to claim 1, wherein when a malfunction occurs in the slag-falling-sound observing unit, a sound generated when the slag falls onto the water surface is observed by the underwater-slag observing unit.

6. The slag monitoring device for a coal gasifier according to claim 1, wherein the slag-hole observing unit is a camera, and the processing device sets a gain of the camera to an automatic adjustment mode and sets a shutter speed of the camera to a maximum or arbitrary value during a period in which an activation burner of the coal gasifier is being ignited, and sets the gain and the shutter speed of the camera to fixed values during loading of coal.

7. The slag monitoring device for a coal gasifier according to claim 1, wherein the processing device determines dirt at a light entrance portion of the slag-hole observing unit based on luminance of an image obtained by the slag-hole observing unit, and when the dirt of the light entrance portion is not allowable, the processing device activates a cleaning unit that cleans the light entrance portion.

8. The slag monitoring device for a coal gasifier according to claim 1, wherein the processing device determines dirt at a light entrance portion of the water-surface observing unit based on luminance of an image obtained by the water-surface observing unit, and when the dirt of the light entrance portion is not allowable, the processing device activates a cleaning unit that cleans the light entrance portion.

9. A coal gasifier comprising the slag monitoring device for a coal gasifier according to claim 1.

10. A slag monitoring device for a coal gasifier, the slag monitoring device comprising:

a slag-hole observing unit that observes a slag hole from which molten slag flows out;

a water-surface observing unit that observes a situation in which the slag flowing out from the slag hole falls onto a water surface of cooling water;

a slag-falling-sound observing unit that observes a sound of the slag falling onto the water surface;

an underwater-slag observing unit including a first wave transmitting/receiving sensor and a second wave transmitting/receiving sensor that can transmit and receive a detection wave is provided below the slag-falling-sound observing unit; and a processing device that determines a solidification and adhesion position of the slag based on an opening area of the slag hole observed by the slag-hole observing unit, and falling lines and falling positions of the slag observed by the water-surface observing unit, and changes over a relation of transmission and reception between the first wave transmitting/receiving sensor and the second wave transmitting/receiving sensor to evaluate deposition of solidified slag in the cooling water based on a detected path of the detection wave.

* * * * *